US008201985B2

(12) United States Patent
Cao

(10) Patent No.: US 8,201,985 B2
(45) Date of Patent: Jun. 19, 2012

(54) LIGHT BULB UTILIZING A REPLACEABLE LED LIGHT SOURCE

(75) Inventor: Densen Cao, Sandy, UT (US)

(73) Assignee: CAO Group, Inc., West Jordan, UT (US)

( * ) Notice: Subject to any disclaimer, the term of this patent is extended or adjusted under 35 U.S.C. 154(b) by 0 days.

(21) Appl. No.: 13/153,167

(22) Filed: Jun. 3, 2011

(65) Prior Publication Data

US 2011/0234082 A1 Sep. 29, 2011

Related U.S. Application Data

(63) Continuation of application No. 11/938,131, filed on Nov. 9, 2007, now Pat. No. 7,976,211, which is a continuation-in-part of application No. 11/397,323, filed on Apr. 4, 2006, now Pat. No. 7,728,345, which is a continuation-in-part of application No. 10/773,123, filed on Feb. 5, 2004, now abandoned, which is a continuation-in-part of application No. 09/939,339, filed on Aug. 24, 2001, now Pat. No. 7,224,001.

(51) Int. Cl.
*H01R 33/945* (2006.01)

(52) U.S. Cl. ..... 362/650; 362/649

(58) Field of Classification Search ..... 362/649, 362/650, 651

See application file for complete search history.

(56) References Cited

U.S. PATENT DOCUMENTS 4,240,090 A 12/1980 Hughes
4,394,679 A 7/1983 Hawrylo
4,674,011 A 6/1987 Patton
4,675,575 A 6/1987 Smith
4,727,289 A 2/1988 Uchida
5,055,892 A 10/1991 Gardner
5,160,200 A 11/1992 Cheselske
5,174,646 A 12/1992 Siminovitch
5,349,599 A 9/1994 Larkins
5,414,281 A 5/1995 Watabe et al.
5,463,280 A 10/1995 Johnson
5,535,230 A 7/1996 Abe
5,595,438 A 1/1997 Burd
5,655,830 A 8/1997 Ruskouski
5,688,042 A 11/1997 Madadi et al.
5,707,139 A 1/1998 Haitz
5,721,430 A 2/1998 Wong
5,758,951 A 6/1998 Haitz
5,765,940 A 6/1998 Levy et al.
5,803,579 A 9/1998 Turnbull
5,806,965 A 9/1998 Deese
5,813,752 A 9/1998 Singer
5,890,794 A 4/1999 Abtahi
5,941,626 A 8/1999 Yamuro
5,941,631 A 8/1999 Hsu
5,947,588 A 9/1999 Huang
5,982,092 A 11/1999 Chen (Continued)

OTHER PUBLICATIONS

Pending U.S. Appl. No. 12/785,203, Office Action dated Nov. 2, 2010.

(Continued)

*Primary Examiner* — David V Bruce

(57) ABSTRACT

The present invention is a light bulb featuring a removable LED light source. The preferred source being a lighting source with a three dimensional lead frame as disclosed in the parent applications to this application. Control circuitry is included to convert electrical power into power usable by the LEDs.

10 Claims, 7 Drawing Sheets

U.S. PATENT DOCUMENTS

| | | | |
|---|---|---|---|
| 6,015,979 | A | 1/2000 | Sugiura |
| 6,045,240 | A | 4/2000 | Hochstein |
| 6,149,283 | A | 11/2000 | Conway |
| 6,238,077 | B1 | 5/2001 | Ramer |
| 6,355,946 | B1 | 3/2002 | Ishinaga |
| 6,357,889 | B1 | 3/2002 | Duggal |
| 6,402,338 | B1 | 6/2002 | Mitzel |
| 6,412,971 | B1 | 7/2002 | Wojnarowski |
| 6,478,453 | B2 | 11/2002 | Lammers |
| 6,499,860 | B2 | 12/2002 | Begemann |
| 6,502,952 | B1 | 1/2003 | Hartley |
| 6,504,180 | B1 | 1/2003 | Heremans |
| 6,541,800 | B2 | 4/2003 | Barnett |
| 6,561,680 | B1 | 5/2003 | Shih |
| 6,577,073 | B2 | 6/2003 | Shimizu et al. |
| 6,580,228 | B1 | 6/2003 | Chen et al. |
| 6,601,962 | B1 | 8/2003 | Ehara et al. |
| 6,635,987 | B1 | 10/2003 | Wojnarowski et al. |
| 6,709,132 | B2 | 3/2004 | Ishibashi |
| 6,715,900 | B2 | 4/2004 | Zhang |
| 6,786,625 | B2 | 9/2004 | Wesson |
| 6,815,241 | B2 | 11/2004 | Wang |
| 6,840,654 | B2 | 1/2005 | Guerrieri et al. |
| 6,903,380 | B2 | 6/2005 | Barnett et al. |
| 6,948,829 | B2 | 9/2005 | Verdes et al. |
| 6,974,233 | B1 | 12/2005 | Aubrey |
| 6,982,518 | B2 | 1/2006 | Chou |
| 7,128,454 | B2 | 10/2006 | Kim |
| 7,150,553 | B2 | 12/2006 | English |
| 7,196,358 | B1 | 3/2007 | Chen |
| 7,490,959 | B2 | 2/2009 | Tsuda |
| 2002/0113244 | A1 | 8/2002 | Barnett |
| 2003/0031032 | A1 | 2/2003 | Wu |
| 2003/0117797 | A1 | 6/2003 | Sommers |
| 2004/0095738 | A1 | 5/2004 | Juang |
| 2004/0201025 | A1 | 10/2004 | Barnett |
| 2004/0264196 | A1 | 12/2004 | Shu |
| 2005/0007772 | A1 | 1/2005 | Yen |
| 2005/0174780 | A1 | 8/2005 | Park |
| 2005/0194607 | A1 | 9/2005 | Barnett |
| 2005/0254246 | A1 | 11/2005 | Huang |
| 2006/0092637 | A1 | 5/2006 | Yeh |
| 2006/0138440 | A1 | 6/2006 | Jyo |
| 2007/0236935 | A1 | 10/2007 | Wang |
| 2007/0253202 | A1 | 11/2007 | Wu |
| 2008/0105886 | A1 | 5/2008 | Borner |
| 2008/0197374 | A1 | 8/2008 | Sung |
| 2011/0021081 | A1* | 1/2011 | Lin ..... 439/641 |

OTHER PUBLICATIONS

Pending U.S. Appl. No. 12/731,939, Office Action dated Nov. 8, 2010.

Pending U.S. Appl. No. 12/296,274, Office Action dated Jan. 6, 2011.

PCT Application, Serial No. PCT/US2007/065995, Written Opinion of the International Searching Authority, Jun. 20, 2008.

* cited by examiner

LIGHT BULB UTILIZING A REPLACEABLE LED LIGHT SOURCE

CROSS-REFERENCES TO RELATED APPLICATIONS

This Application is a continuation of U.S. application Ser. No. 11/938,131 filed on Nov. 9, 2007, which in turn is a continuation-in-part of prior U.S. application Ser. No. 11/397,323, filed Apr. 4, 2006, now U.S. Pat. No. 7,728,345, which is in turn a continuation-in-part of U.S. application Ser. No. 10/773,123, filed Feb. 5, 2004, which is a continuation-in-part of U.S. application Ser. No. 09/939,339, filed Aug. 24, 2001, now U.S. Pat. No. 7,224,001. Each of the above cross-referenced patent applications is hereby incorporated by reference in its entirety.

FIELD OF THE INVENTION

The present invention relates to the field of lighting sources and more particularly relates to a light bulb, usable in standard incandescent lighting fixtures and also utilizing a replaceable LED as a lighting source.

BACKGROUND OF THE INVENTION

Since Edison's invention of the incandescent lamp, lighting has never been the same. The "light bulb," as they have come to be known, is perhaps one of the most ubiquitous and most little thought of elements in modern society. The whole system has become standardized in design and construction so that standard sockets are installed in new homes that will fit a standard bulb, lamps use standard bulbs of a given size, and new lighting fixtures feature sockets fitting whatever type of standard bulb the purchaser desires. The technology is very simple and light bulbs are mass produced to the point where consumers think nothing of just throwing away burnt out bulbs and going to the local grocery store to buy more.

However, society has become more energy and recourse conscious. As a result, consumers demand more efficient and longer lasting lighting solutions. Some governments are even considering banning incandescent bulbs. To this effect, halogen and compact fluorescent bulbs have been developed for consumer use. Halogens, unfortunately, do not use the standard bulb sockets that are present in almost every home and office. Compact fluorescents do use standard sockets and do use less energy, but they tend to be larger and are also meant to be disposed as a unit when the bulb reaches the end of its useful life. The disposal of the compact fluorescence lamp also results in environmental issues since they contain mercury.

LED's have recently been investigated as more efficient and environmental friendly light source. The present invention is an LED sourced light bulb where the LEDs are mounted upon a stable and replaceable frame, thereby reducing resources lost in disposal and associated cost. The present invention represents a departure from the prior art in that the light bulbs of the present invention allows for replacement of just the LED light source while retaining the majority of the body of the bulb. The present invention may be adapted for any type of socket interface, and it is preferred to use the standard light bulb socket, which would allow for interchange with the majority of sockets in the US and worldwide.

SUMMARY OF THE INVENTION

In view of the foregoing disadvantages inherent in the known types of light bulbs, this invention provides a light bulb utilizing an LED lighting source. As such, the present invention's general purpose is to provide a new and improved light bulb that is useable in standard light sockets available today while having most of its components reusable when the LED components eventually fail. It is also part of the invention's purpose to allow for the efficient use of LEDs, that is that there is maximum dissipation of heat generated by the LEDs for their most efficient use.

To accomplish these objectives, the light bulb comprises a socket base, an LED light source that is removable from the base and a removable cover. Control circuitry resides within the socket base to control the LEDs and regulate the power supply. Ideally, a removable inner socket is provided as an intermediary between the socket base and the LED lighting source.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the light bulb is herein described. It should be noted that the articles "a", "an", and "the", as used in this specification, include plural referents unless the content clearly dictates otherwise.

Figure 1:
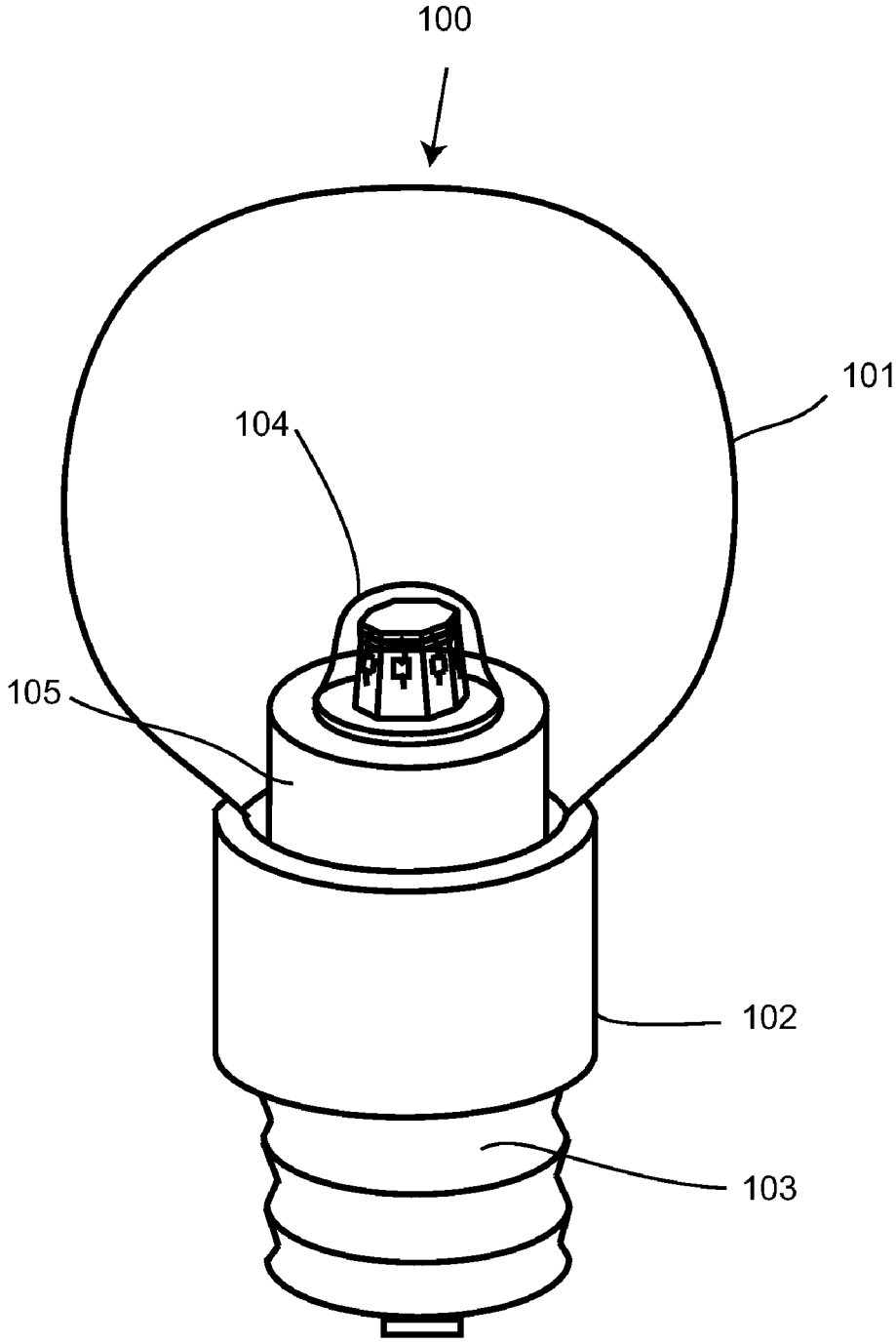
FIG. 1 is a side elevation of a light bulb according to the present invention.

With reference to FIG. 1, depicting a standard light bulb 100 with an LED light source 104, having a cover 101(type A), which can be glass or transparent plastic and a light base 102. Base 102 houses control circuitry and other components necessary for the function of the LEDs and it has a threaded portion 103, which screws into a standard light socket. The replaceable LED unit 104, which disclosed in parent U.S. application Ser. No. 11/397,323, resides within the bulb cover, mounted upon an internal socket 105 which mates with both the LED unit 104 and the inside of the light base 102. The socket 105 also acts as heat sink to dissipate the heat from LED. LED unit may be any type of unit in the prior art or later designed, however it is preferred to use LED units such as described in this Application's ancestor applications and patents. In this depicted embodiment, the LED unit 104 will emit light in an arc from 5 to 360° in the horizontal plane and from a 5 to 360° arc in the vertical plane, which is comparable to a standard incandescent light bulb.

Figure 2:
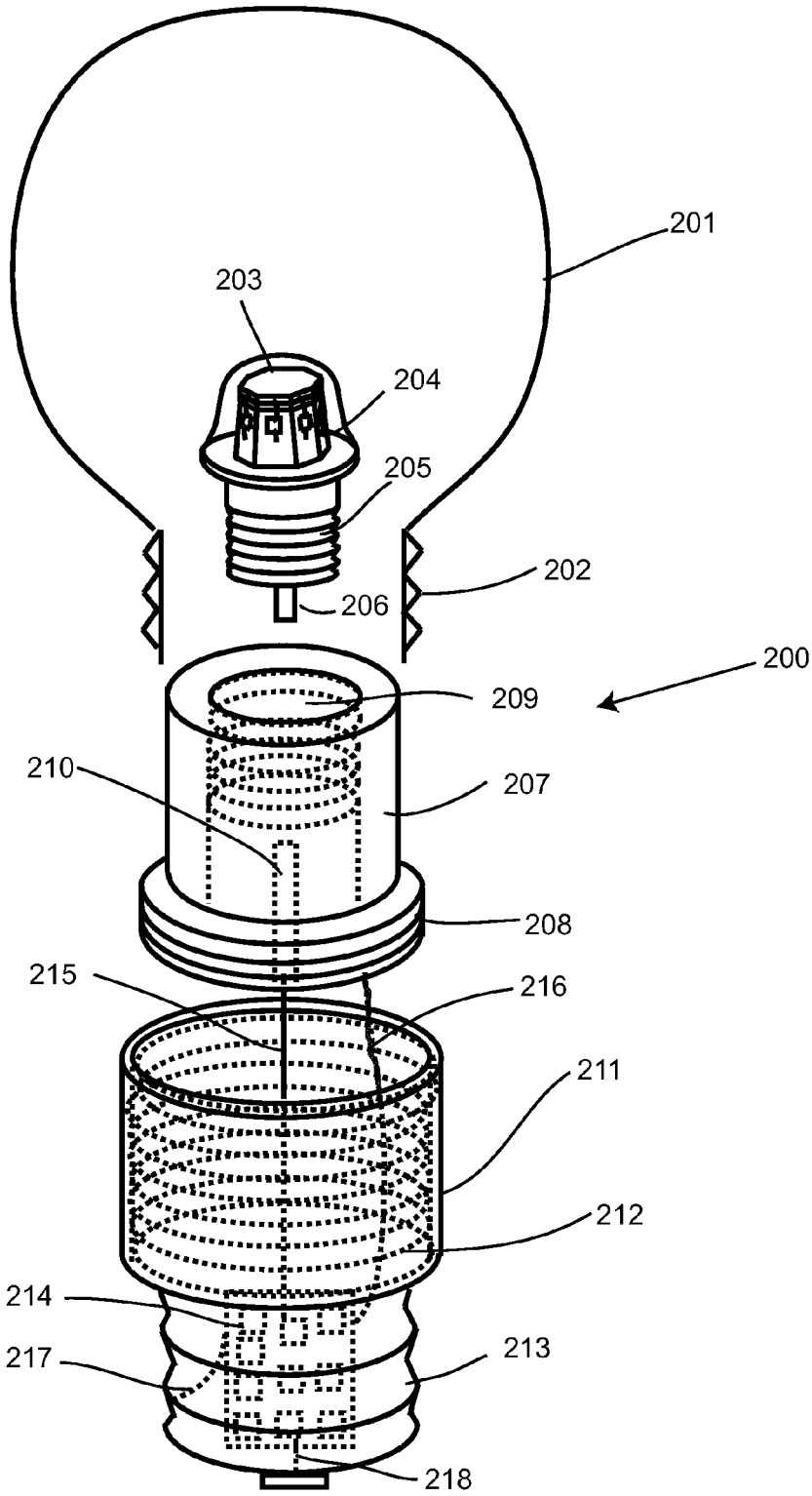
FIG. 2 is an exploded view, in partial transparency, of the light bulb of FIG. 1.

The construction of the bulb is relatively simple, as shown in FIG. 2. Cover 201 features a threaded base 202 which screws into threads 212 in the socket base 211. LED unit 203 is at least one replaceable LED with a three dimensional lead frame 204, a threaded base/electrode 205, and another electrode pin 206. Threaded base 205 screws into internal socket 207 through hole 209. While shown as threaded, it should be understood that any interlocking structure will suffice to keep the LED mounted. The internal socket 207 features a threaded base 208 to mate with threads 212 and attach to the socket base 211, under cover 201. When assembled, electrical connector 210 connects to electrode 206. Socket base 211 is features a standard threaded base 213 and houses an electronic circuit 214 to convert 110 or 220 VAC to DC to drive the LED. Electronic circuit 214 has outputs 215 and 216 to LED electrodes and also has outputs 217 and 218 to the threaded base. To increase total light output intensity, the number of replaceable LED can be ranged from 1 to n, which is an integer larger than 1. LED unit 203 may be either removable or fixed within the internal socket.

In this embodiment, the number of replaceable LEDs as a light source can be 1 to n, which is an integer larger than 1. When the number of LEDs is larger than 1, the LEDs can be mounted along with socket in different angles to achieve different lighting effects. It should also be understood that the cover 201 may be made in a fixed, non-removable, relationship with the socket base 21, though this would preclude LED replacement.

Figure 3:
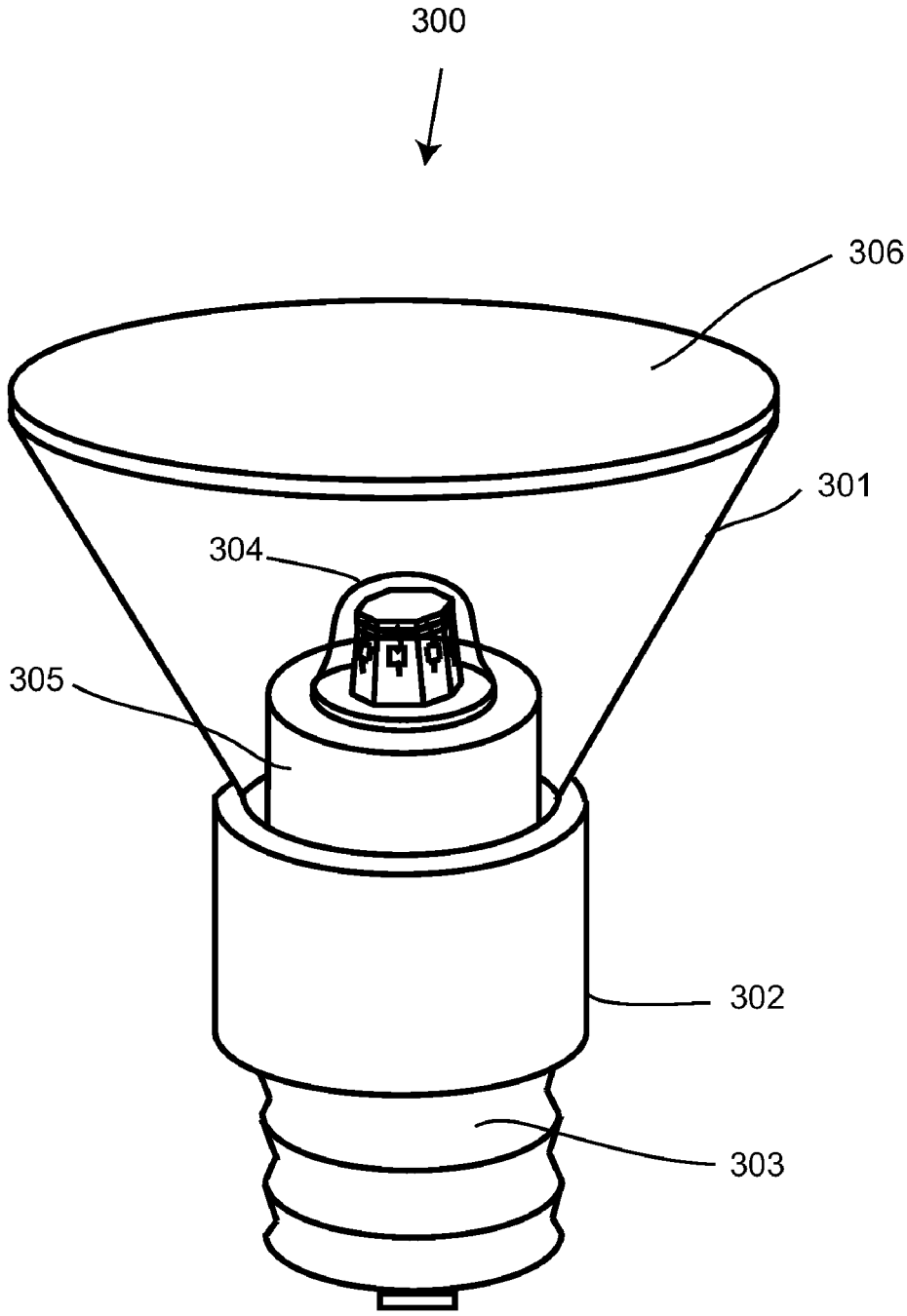
FIG. 3 is a side elevation of a down-lighting light bulb according to the present invention.
Figure 4:
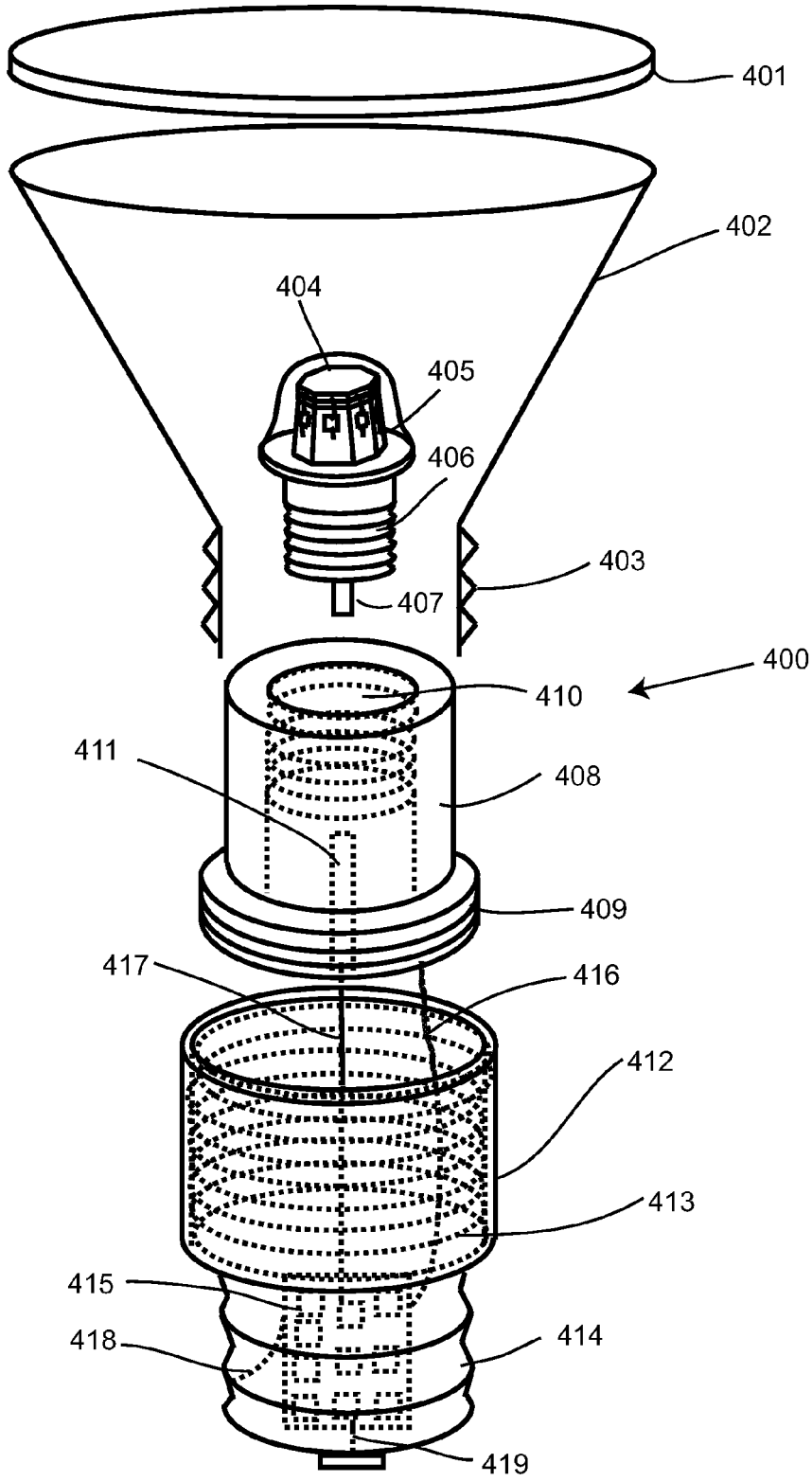
FIG. 4 is an exploded view, in partial transparency, of the light bulb of FIG. 3.

FIG. 3 depicts a light bulb embodiment that is a down lighting light with a replaceable LED 300 (type R) with an LED light source 304, having a reflecting cup 301 as a cover which can be glass or transparent plastic and a light base 302. Reflecting cup features a cover or lens 306 to help beam dispersion and reflector protection. Like the first embodiment, base 302 houses control circuitry and other components necessary for the function of the LEDs and it has a threaded portion 303, which screws into a standard light socket. The replaceable LED unit 304 resides within the bulb cover, mounted upon an internal socket 305 which mates with both the LED unit 304 and the inside of the light base 302. The socket 305 also act heat sink to dissipate the heat from LED. The construction of the bulb is shown in FIG. 4. Cover 402 features lens 401 a threaded base 403 which screws into threads 413 in the socket base 412. LED unit 404 is a replaceable LED with a three dimensional lead frame 405, a threaded base/electrode 406, and another electrode pin 407. Threaded base 406 screws into internal socket 408 through hole 410. The internal socket 408 features a threaded base 409 to mate with threads 413 and attach to the socket base 412, under cover 402. When assembled, electrical connector 411 connects to electrode 407. Socket base 412 is features a standard threaded base 414 and houses an electronic circuit 415 to convert 110 or 220 VAC to DC to drive the LED. Electronic circuit 415 has outputs 416 and 417 to LED electrodes and also has outputs 418 and 419 to the threaded base. As before, to increase total light output intensity, the number of replaceable LEDs can be ranged from 1 to n, which is an integer larger than 1.

Figure 5:
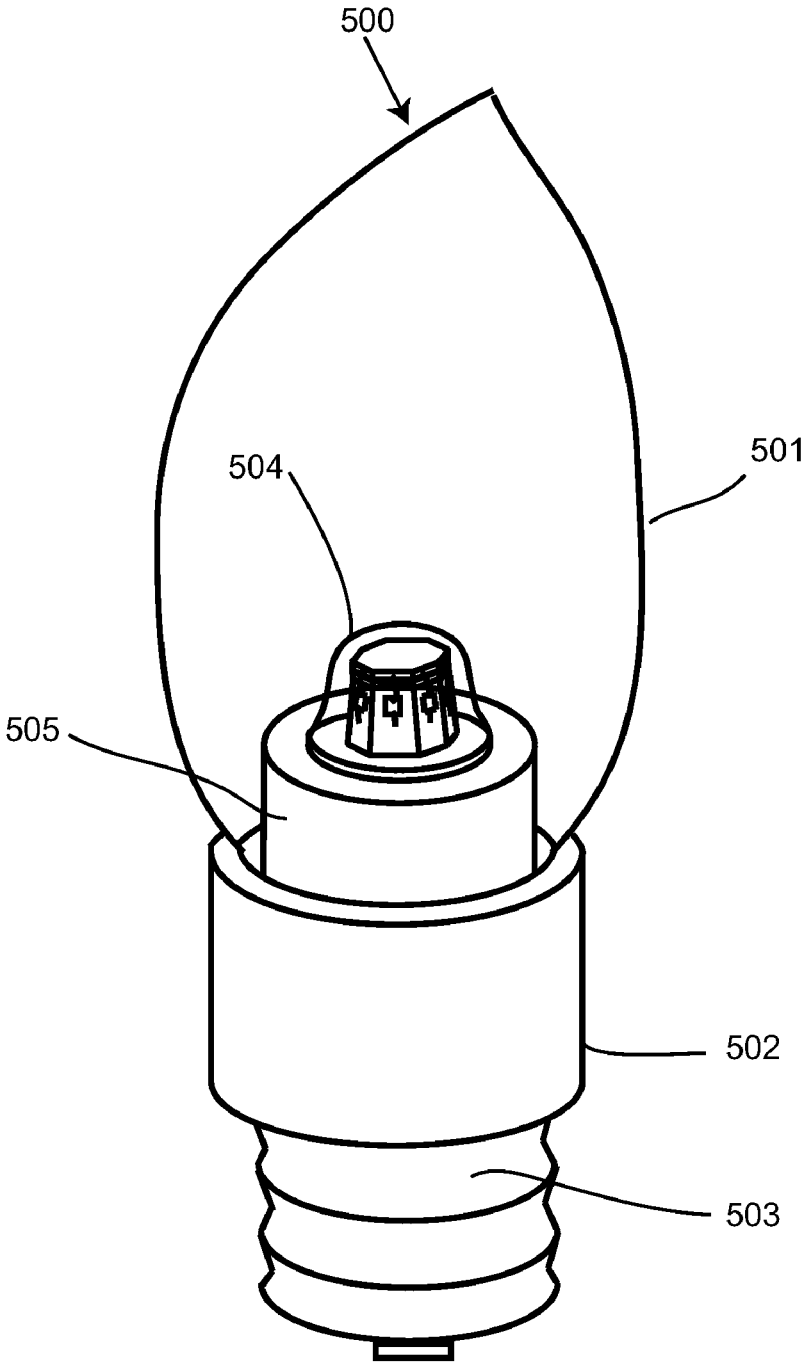
FIG. 5 is a side elevation of a decorative, candelabra style light bulb according to the present invention.
Figure 6:
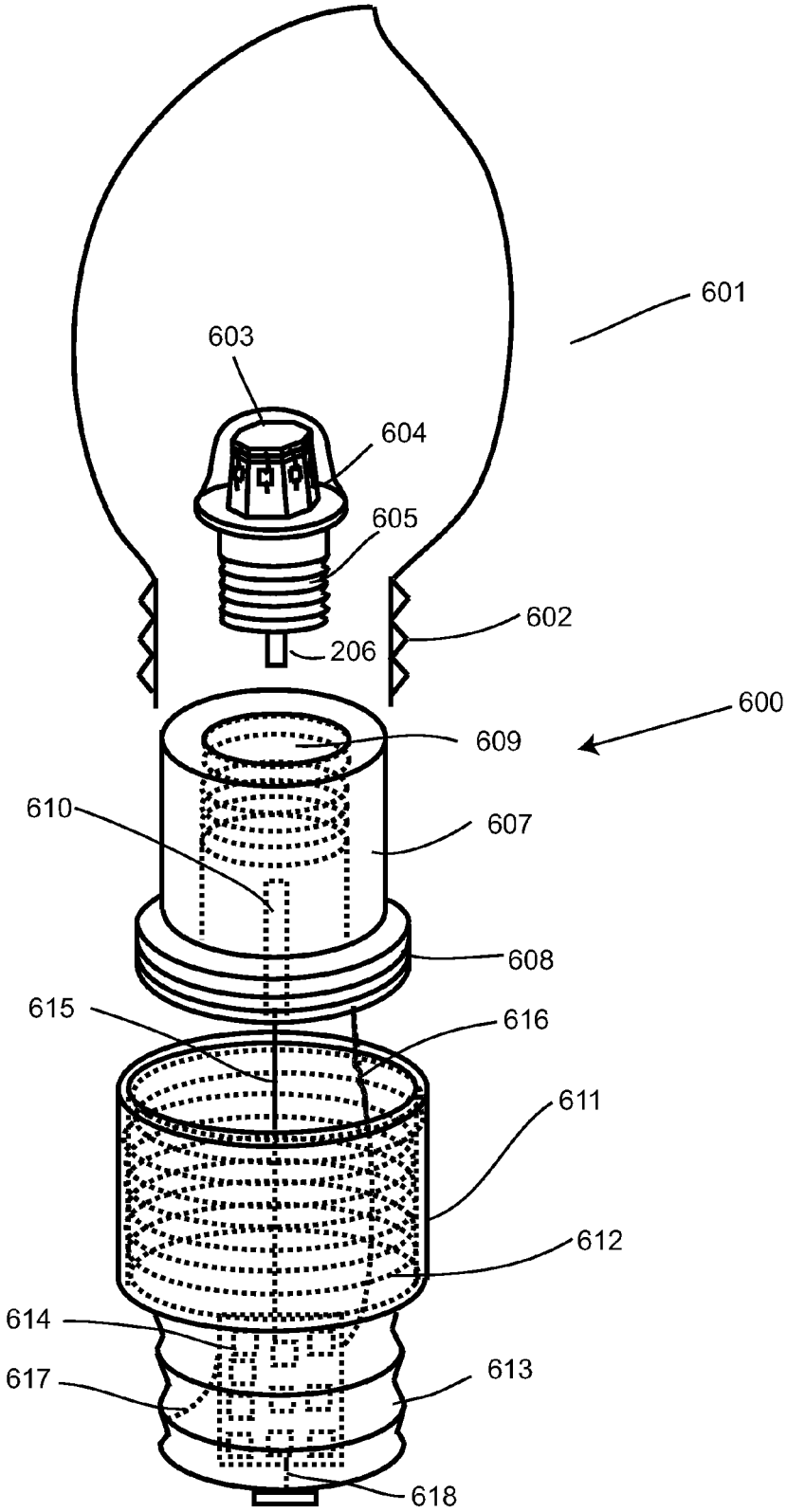
FIG. 6 is an exploded view, in partial transparency, of the light bulb of FIG. 5.
Figure 7A:
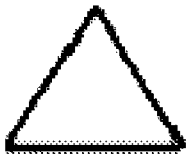
FIGS. 7*a* through 7*f* are schematics of a number of possible lead frame shapes for use in the present invention.
Figure 7B:
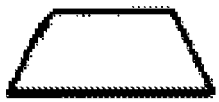
Figure 7C:
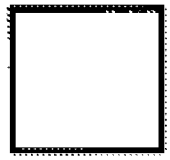
Figure 7D:
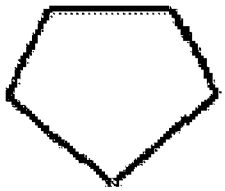
Figure 7E:
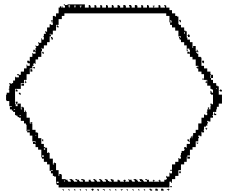
Figure 7F:
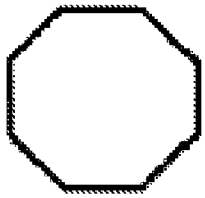

FIGS. 5 and 6 depict a decorative candelabra style bulb 500 (type D) and the same bulb 600 in an exploded view. The configuration is similar to the bulb depicted in FIGS. 1 and 2, with the only real change being the shape of the cover 601. The components illustrated are then similarly numbered as their counterparts in FIGS. 1 and 2 and otherwise function and relate in the same manner. As illustrated, the covers may be of any shape used in the industry today, or later. These shape types include: General ("A"), Globe ("G"), Decorative ("D"—which includes candelabra, teardrop and other imaginative shapes), and reflector bulbs (having a reflective coating inside the bulb), including General Reflectors ("R"), Floods ("FL"), Spots ("SP"), and Parabolic Reflectors ("PAR"). Also, covers may be made of textured material, including plain (or no texture) or frosted material, as is also known in the industry today.

In all above different embedment, the total number of replaceable LEDs can be 1 to n, which is larger than 1. When multiple replaceable LEDs are used, the LEDs can be mounted in either on a plain or different angle or different shape of the base.

The replaceable LEDs used in the invention is a light source to emit light in different directions due to its lead frame design as described in U.S. application Ser. No. 11/397,323. The shape of the lead frame for LED light source may vary according to purpose. FIG. 7 depicts a number of possible lead frame shapes on which LED chips are mounted. The different shapes of lead frame for LED can serve different applications. For instance, an LED could be mounted on all sides but the long side of the shape in FIG. 7*b*, which would provide light in an arc less than 360° (n less than the number of faces). Multiple LEDs (n greater than the number of faces) could also be mounted upon the same face, even if LEDs are not mounted upon all faces, providing more light.

Actual structuring of the bulbs according to the present invention then is a simple matter. The socket base is depicted in the Figures to fit in a standard Edison screw-type light socket ("MES") with its threaded portion. The base may of course be made to fit any type of lighting interface, including the canedelabra screw base, as used in nightlights and other small lights, the simple plug in variety used in strings of mini lights (typically used for Christmas trees), the double contact bayonet cap ("BC") and current halogen fittings G4, GY4, and RIs-75. Adapting the disclosed preferred embodiment to fit these fittings should be intuitive for those skilled in the art.

In use, the current passes into the threaded portion of the socket base and into the control circuitry. The control circuitry then converts the AC current on to DC current to power the LEDs and passes the current into the interior socket which, in turn, passes the current to the LED light source and the individual LEDs. The light sources depicted and considered best mode of use in this Application are those depicted in parent Applications and feature a plurality of LEDs mounted on a lead frame in a manner to cast light in a 360 degree arc (though less than 360 degrees is possible, and may be desired, through limited placement of the LEDs on the lead frame). The lead frame provides adequate heat dissipation, physical mounting and electrical contact to the LEDs. When the LEDs eventually bum out (which would be many times longer than any bulb on the market today), the consumer merely removes the bulb from electrical contact and then removes the cover by merely twisting it off. The light source is then removed from the internal socket and replaced. The cover is replaces and the bulb returned to its original socket. The majority of the components are preserved, leading to less resource waste. It is possible for the internal socket to be permanently affixed to the socket base (with either a physical stop, an adhesive or a soldiered connection) as well as being able to be removed.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A light source, comprising:

a replaceable LED unit having an interlocking structure element;

a socket having a corresponding interlocking structure element that mates with the interlocking structure element of the replaceable LED unit;

a base supporting the socket, the base capable of interfacing with a lighting fixture; and operable electrical connections between the base and the replaceable LED unit.

2. The light source recited in claim 1, wherein the interlocking structure element and the corresponding interlocking structure element are screw threads.

3. The light source recited in claim 1, wherein the replaceable LED unit comprises a plurality of LEDs.

4. The light source recited in claim 3, wherein the plurality of LEDs are arranged on the replaceable LED unit to direct light in different directions with respect to the light source.

5. The light source recited in claim 4, wherein the replaceable LED unit comprises a polygonal profile with n faces, n being an integer larger than 2, and wherein at least one of the plurality of LEDs are arranged on at least one face of the replaceable LED unit.

6. The light source recited in claim 1, further comprising a removable cover that attaches to the base and at least partially covers the removable LED unit.

7. The light source recited in claim 6, wherein the removable cover permits transmission of light through the cover.

8. The light source recited in claim 7, wherein when the removable cover is removed a user has access to the replaceable LED unit to remove the replaceable LED unit and install a new replaceable LED unit.

9. The light source recited in claim 8, wherein the removable cover comprises interlocking threads that interface with corresponding interlocking threads on the base.

10. The light source recited in claim 1, wherein the operable electrical connections comprise control circuitry electrically connected to the base to convert the electrical current from AC to DC.

* * * * *